US007766754B2

(12) United States Patent
Davison, Jr. et al.

(10) Patent No.: US 7,766,754 B2
(45) Date of Patent: Aug. 3, 2010

(54) AMUSEMENT RIDE SYSTEM AND METHOD OF USE THEREOF

(76) Inventors: Daniel P. Davison, Jr., 50 Distribution Blvd., Edison, NJ (US) 08817; Richard H. Remmer, 52 Main St., Sayville, NY (US) 11782

( * ) Notice: Subject to any disclaimer, the term of this patent is extended or adjusted under 35 U.S.C. 154(b) by 784 days.

(21) Appl. No.: 11/431,069

(22) Filed: May 8, 2006

(65) Prior Publication Data

US 2006/0254099 A1 Nov. 16, 2006

Related U.S. Application Data

(60) Provisional application No. 60/678,983, filed on May 9, 2005.

(51) Int. Cl.
*A63G 1/34* (2006.01)
*A63G 1/00* (2006.01)

(52) U.S. Cl. ..... 472/43; 472/59; 472/136; 40/427

(58) Field of Classification Search ..... 472/43, 472/59, 60, 130, 136, 137; 104/53; 40/427
See application file for complete search history.

(56) References Cited

U.S. PATENT DOCUMENTS 845,967 A * 3/1907 Moscovitz ..... 104/67
1,422,764 A * 7/1922 Irsch ..... 104/53
1,906,763 A * 5/1933 Maynes ..... 104/53
3,696,555 A * 10/1972 Bales et al. ..... 446/430
4,165,695 A 8/1979 Schwarzkopf
4,821,647 A 4/1989 Powell et al.
4,865,550 A * 9/1989 Chu ..... 434/267
4,920,890 A * 5/1990 Barber ..... 104/53
6,105,507 A * 8/2000 Jelf et al. ..... 104/53
6,158,354 A 12/2000 Eiraku
6,523,479 B1 2/2003 Schilke et al.
6,551,108 B1 * 4/2003 Weinspach ..... 434/266
6,637,341 B2 * 10/2003 Kroon et al. ..... 104/53
6,755,749 B2 6/2004 Stengel
6,845,586 B1 1/2005 Brock, IV
7,015,875 B2 3/2006 Wampler et al.
7,024,830 B2 4/2006 Schiedegger et al.
7,025,353 B2 4/2006 Lydick
7,025,655 B2 4/2006 Chase

FOREIGN PATENT DOCUMENTS

EP 0745552 12/1996

* cited by examiner

*Primary Examiner*—Kien T Nguyen
(74) *Attorney, Agent, or Firm*—Winstead PC

(57) ABSTRACT

One embodiment of the invention discloses a method for animating an advertising device. The method comprising multiple steps such as providing a track system and a tower that is operatively coupled to the track. The tower can comprise one or more substantially transparent sections. The method further comprises providing a base support system that is operatively coupled to the tower. The base can be operatively coupled to a facade with one or more substantially non-transparent sections. The method further includes providing a vehicle system comprising a passenger-carrying vehicle that is operatively coupled to the track. Finally, the method includes animating the advertising device by transporting the vehicle between the substantially transparent section of the tower and the substantially non-transparent section of the facade. The vehicle movement can, for example, simulate fluid movement between the tower and the facade.

19 Claims, 4 Drawing Sheets

AMUSEMENT RIDE SYSTEM AND METHOD OF USE THEREOF

CROSS REFERENCE TO RELATED APPLICATIONS

This application claims the benefit of Provisional Application No. 60/678,983 filed May 9, 2005.

BACKGROUND

1. Field of the Invention

The present invention relates generally to entertainment and advertising facilities. More specifically, the present invention relates to facilities related to themed exhibits leading to one or more amusement rides, such as tower rides, bungee rides and rollercoasters, that are partially or entirely sheathed in a mantle or facade, which is used as an advertising venue.

2. Description of the Related Art

It will become apparent to one skilled in the art that the claimed subject matter as a whole, including the structure of the system, and the cooperation of the elements of the system, combine to result in the unexpected advantages and utilities of the present invention. The advantages, features and objects of the present invention will become apparent to those skilled in the art when read in conjunction with the accompanying description, drawing figures, and appended claims.

Well-designed theme amusements are known in the art. Proven models are, for example, Disney's Tower of Terror in Orlando, the London Dungeon (London, England) and the Stratosphere Tower in Las Vegas. The Tower of Terror combines a theme with an exhilarating ride on an expensive tracked vehicle. The London Dungeon ride is based on shock value and interactive history exhibits, combined with a common and inexpensive ride. The Stratosphere ride demonstrates the utility of a stand-alone ride at a premium location.

New ride technology has also been designed, such as the Turbo Drop from S&S Power (Utah), which has manufactured a world-class ride analogous to the Tower of Terror. S&S Power manufactures several rides which are state of the art and that deliver a major rush. In addition, the rides are reasonably priced compared to simulators and tracked vehicles. Furthermore, the rides require a minimum footprint. For example, Turbo Drop Tower incorporates a slow ride to the top with a short stop on the way up, then a blast down, faster than freefall, at 44 miles per hour. Its height can be 185 feet. Its safety envelope can be 24 feet by 24 feet and its foundation can be 44 feet by 44 feet. The Tower is strong enough to partially "hang" an enclosing silo of glass and steel for all weather protection. Its speed can be 40 miles per hour. Its duration can be 90 seconds and its passenger capacity generally can be 16. It's throughput can be 300-340 people per hour.

SUMMARY OF THE INVENTION

As to those skilled in the art will appreciate, the conception on which this disclosure is based readily may be used as a basis for designing other structures, methods, and systems for carrying out the purposes of the present invention. The claims, therefore, include such equivalent constructions to the extent the equivalent constructions do not depart from the spirit and scope of the present invention. Further, the abstract associated with this disclosure is neither intended to define the invention, which is measured by the claims, nor intended to be limiting as to the scope of the invention in any way.

It should be understood that any one of the features of the invention may be used separately or in combination with other features. It should be further understood that features which have not been mentioned herein may be used in combination with one or more of the features mentioned herein. Other systems, methods, features, and advantages of the present invention will be apparent to one with skill in the art upon examination of the drawings and detailed description. It is intended that all such additional systems, methods, features, and advantages be protected by the accompanying claims.

One embodiment of the invention discloses a method for animating an advertising device. The method comprising multiple steps such as providing a track system and a tower that is operatively coupled to the track. The tower can comprise one or more substantially transparent sections. The method further comprises providing a base support system that is operatively coupled to the tower. The base can be operatively coupled to a facade with one or more substantially non-transparent sections. The method further includes providing a vehicle system comprising a passenger-carrying vehicle that is operatively coupled to the track. Finally, the method includes animating the advertising device by transporting the vehicle between the substantially transparent section of the tower and the substantially non-transparent section of the facade. The vehicle movement can, for example, simulate fluid movement between the tower and the facade. In one embodiment of the invention, the animation step simulates fluid transfer within a drinking straw. In another embodiment of the invention, the animation step simulates fluid transfer within a thermometer. In some embodiments, the track can comprise an elastic band and the vehicle can comprise a harness. In still other embodiments of the invention, the vehicle simulates a mass of fluid such as, for example, a drop of water or mercury.

An additional embodiment of the invention comprises an advertising billboard device. The device comprises a track system and a base support system that is operatively coupled to the track. The base is also operatively coupled to a facade. The facade comprises a first slot. The embodiment further comprises a vehicle system with a passenger-carrying vehicle that is operatively coupled to the track. The track passes through the first slot thereby allowing the vehicle to travel along the track and through the slot. This movement enhances consumer interest in the billboard device. In one embodiment of the invention, the facade can comprise a second slot wherein the track passes through the first slot and the second slot. Allowing the vehicle to travel along the track and through the first slot and the second slot enhances consumer interest in the billboard device.

BRIEF DESCRIPTION OF THE DRAWINGS

The invention may take physical form in certain parts and arrangement of parts. For a more complete understanding of the present invention, and the advantages thereof, reference is now made to the following descriptions taken in conjunction with the accompanying drawings, in which.

DESCRIPTION OF THE PREFERRED EMBODIMENT(S)

The following discussion is presented to enable a person skilled in the art to make and use the invention. The general principles described herein may be applied to embodiments and applications other than those detailed below without departing from the spirit and scope of the present invention as defined by the appended claims. The present invention is not intended to be limited to the embodiments shown, but is to be accorded the widest scope consistent with the principles and features disclosed herein.

Figure 1:
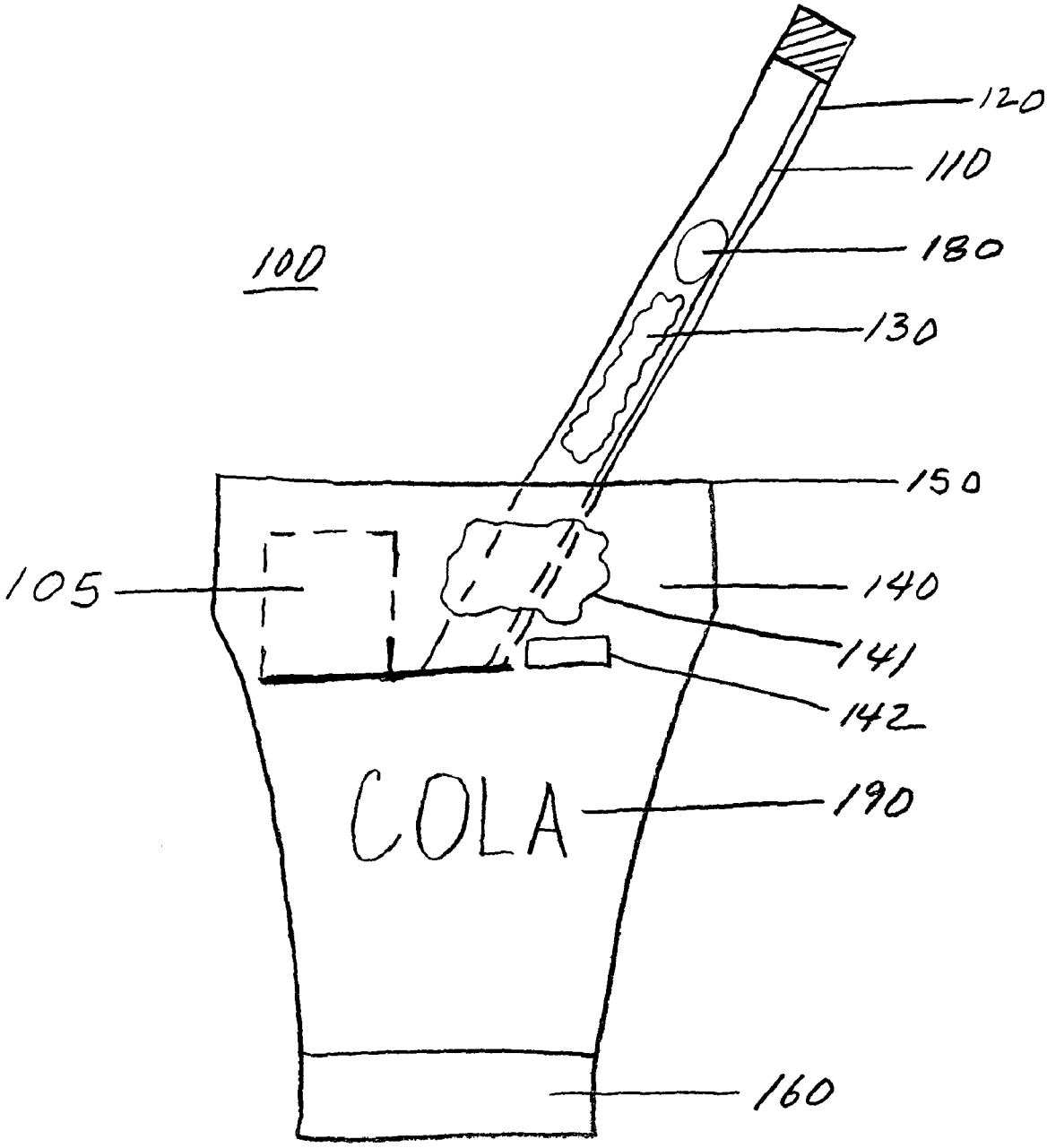
FIG. 1 illustrates a front view of an embodiment of the invention.

FIG. 1 illustrates an embodiment of invention. The advertising device 100 can be, for example, a three-dimensional structure generally disclosing a drinking glass and a drinking straw. The device 100 includes a track system 110 placed within a tower 120. The tower 120 can include a substantially transparent section 130. A base support system 150 is operatively coupled to the tower 120 and a facade 140 with one or more substantially non-transparent sections 141. The facade 140 may also have transparent sections 160. The transparent sections may be used for, as an example, a retail center located on the first floor of the device 100. The device 100 can also include a vehicle system comprising a passenger-carrying vehicle 180 that is operatively coupled to the track 110. The vehicle may, for example, be large enough to carry four human passengers. The track 110 passes between the transparent section 130 of the tower 120 and the non-transparent section 141 of the facade 140.

As the vehicle 180 passes along the track 110, a creative visual effect is gained. For example, the tower 120 can be constructed and painted to resemble a drinking straw. The facade 140 can be constructed and painted to resemble a multi-story drinking glass. The vehicle 180 may be constructed and painted to resemble a mass of fluid such as, for example, a droplet of soda pop. In some embodiments of the invention, multiple vehicles 180 may be coupled together to resemble multiple droplets of soda or even a stream of soda. Thus, passengers can sit in a vehicle 180. A motor 142 can drive the vehicle 180 up the rails 110 to the top of the tower 120. The visual effect of the one or more vehicles 180 sliding up the tower 120 will resemble, for example, soda being sipped through a straw. Then, the vehicle 180 can be released in an absolute or modified free-fall. In other words, the vehicle 180 may descend as if in free-fall or, for example, faster than free-fall. As the vehicle 180 slides down the tower 120, the visual effect will be that of, for example, soda sliding down a straw. To further dramatize the effect, signage 190 may be affixed to the device 100. For example, the signage 190 may be that of a soda pop manufacturer. The signage 190 can, in the above example, add to the visual effect of soda sliding in a straw and, at the same time, generate advertising revenue. In one embodiment of the invention, the base 150 can have a small footprint and be coupled to an existing building. Therefore, the device 100 is suitable for dense urban settings.

In another embodiment of the invention, the tower 120 may be constructed to resemble a thermometer. The vehicle 180 can be constructed to resemble a droplet of, for example, mercury. Thus, the movement of the one or more vehicles 180 up and down the tower 120 will resemble the temperature in a thermometer getting hotter or cooler.

In some embodiments of the invention, the tower 120 may be substantially vertical. In some embodiments of the invention, the track 110 may resemble a rollercoaster. However, in other embodiments, the track 110 can be comprised of elastic bands and the vehicle 180 can comprise a harness. Thus, the passengers in the vehicle can then "bungee jump" from the top of the tower 120 to the bottom of the tower. As addressed in an aforementioned example, the tower 120 may resemble a thermometer. The track 110 and vehicle 180 may be constructed to simulate mercury. Thus, as the passenger bounces up and down, the visual effect will be that of temperature rising and falling. To further the effect, the facade 140 may resemble a sick patient with a thermometer in his mouth. The signage may be, for example, for a commercially available pain reliever.

Figure 2:
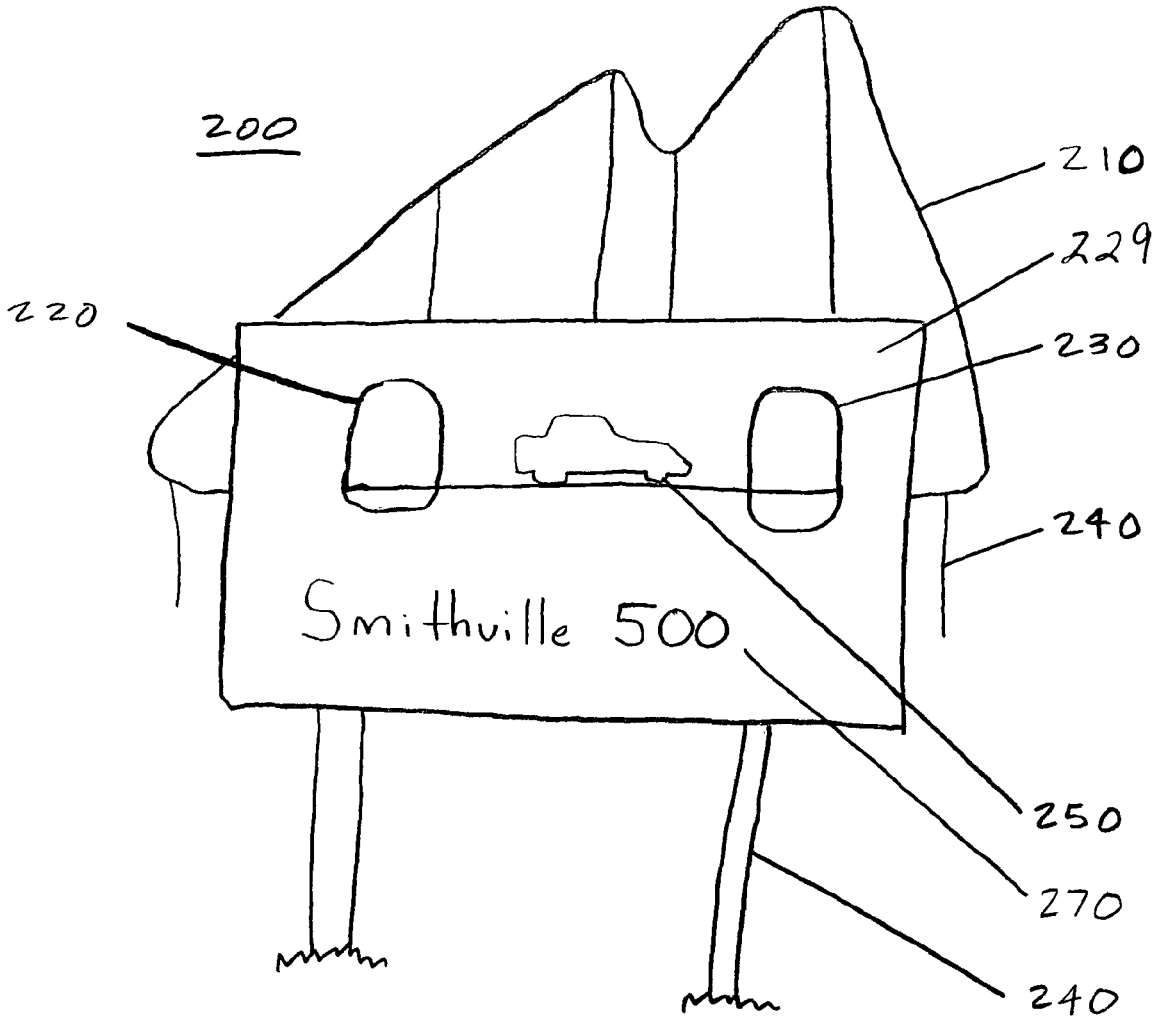
FIG. 2 illustrates a front view of an embodiment of the invention.

FIG. 2 discloses an alternative embodiment of the invention. FIG. 2 discloses an advertising billboard 200. The billboard 200 comprises a track system 210 and a base support system 240. A facade 229 is coupled to the track 210 and base 240. In one embodiment of the invention, the facade 229 includes a first slot 220 and a second slot 230. The slots can be holes in the facade 229 or, for example, portions removed from the perimeter of the facade 229. The advertising billboard 200 further comprises a vehicle system comprising a passenger-carrying vehicle 250 that is operatively coupled to the track 210. The track 210 passes through the first slot 220 and second slot 230. As the vehicle 250 travels along the track 210 between the slots 220, 230, consumer interest in the billboard is enhanced. The billboard 200, can have signage 270, to advertise a cause. For example, the facade 229 can be painted to resemble a racetrack. The vehicle 250 can be constructed to simulate a race car. Signage 270 can be employed to advertise, for example, an annual car race that is hosted by the local community. Thus, as the vehicle 250 races along the track 210 and passes in and out of the slots 220, 230 in the billboard, the "car race" visual effect is gained and draws consumer attention to the facade 229 and the associated advertising message.

The invention can, for example, be used to generate advertising revenue. In addition, the invention can generate money received from users that wish to ride the vehicle over the, for example, rollercoaster comprised of the aforementioned rails 210 and base 240.

Figure 3:
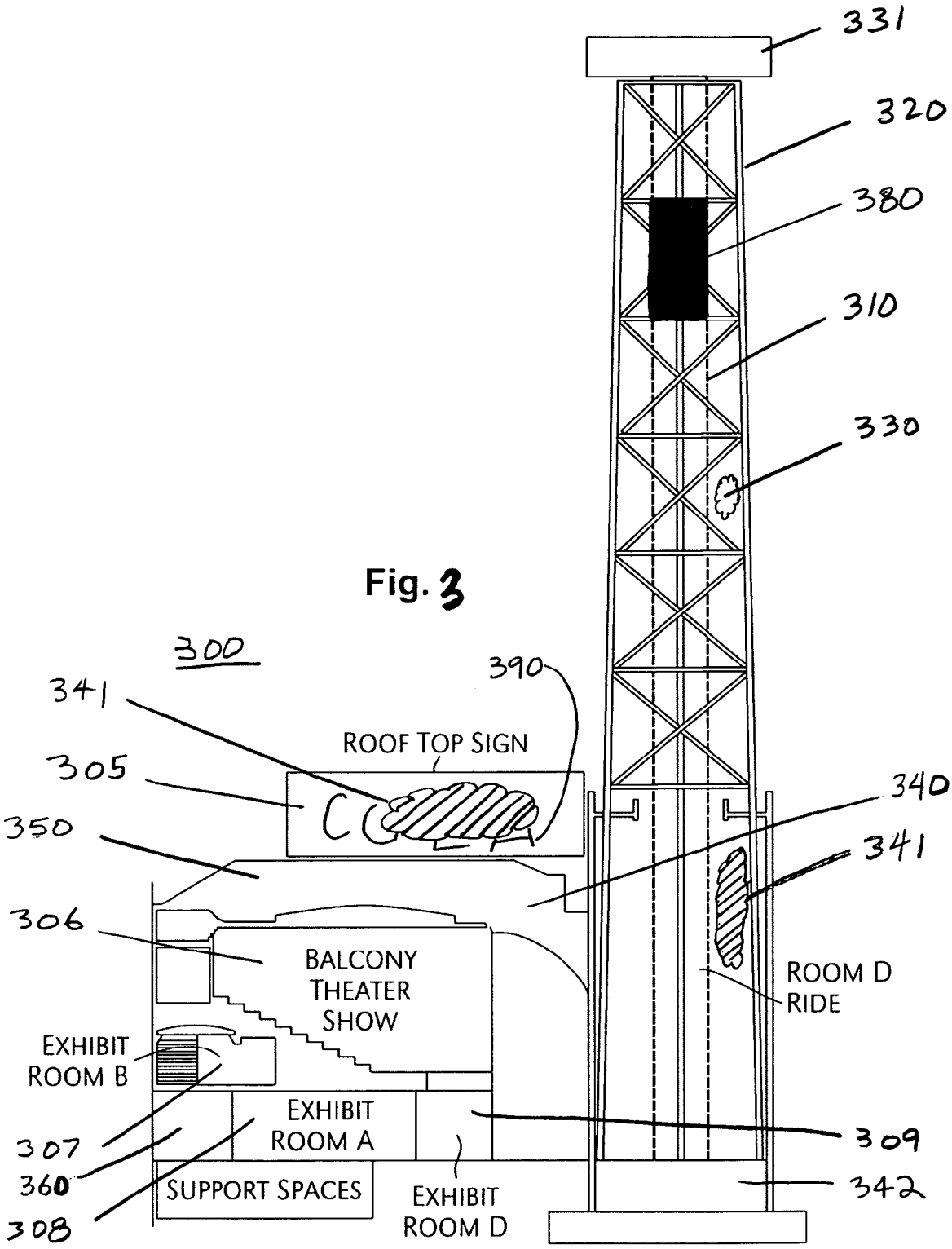
FIG. 3 illustrates a front view of an embodiment of the invention.

FIG. 3 discloses another embodiment of the invention. The advertising device 300 is a three-dimensional structure with a track system 310 placed within a tower 320. The tower 320 includes a substantially transparent section 330. The tower also has a nontransparent section 331. A base support system 350 is coupled to the tower 320 and a facade 340. The facade 340 has one or more substantially non-transparent sections 341. The facade 340 may also have transparent sections 360 that can be used as a retail center. The device 300 can also include a passenger-carrying vehicle 380 that is operatively coupled to the track 310. The track 310 passes between the transparent section 330 of the tower 320 and the non-transparent section(s) 341 of the facade 340. The facade 340 may be comprised of a single panel or multiple panels. The facade 340 provides an excellent opportunity for signage 390. Signage may also be placed in, for example, an interior wall of the tower 320. The base 350 may include several rooms or chambers 309, 308, 307, 306 for retail (e.g., kiosks) and/or entertainment (e.g., theater shows) purposes. Machinery (e.g., motors) may be housed in, for example, a chamber 342 coupled to the tower 320.

Figure 4:
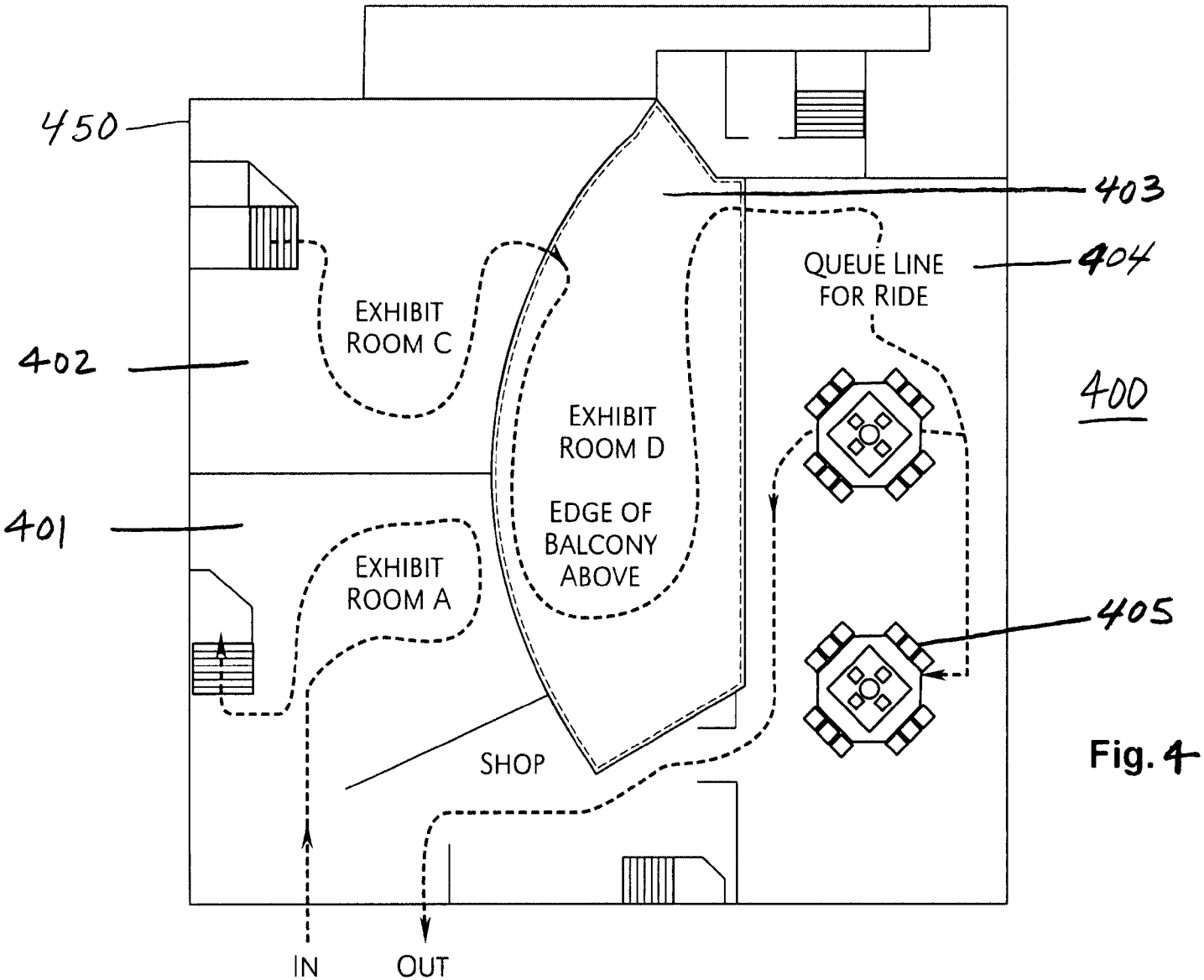
FIG. 4 illustrates a floor plan of an embodiment of the invention.

FIG. 4 illustrates another embodiment of the invention. Multiple rooms 401, 402, 403, 404 are disclosed in a base structure 450. The rooms are guide passengers through various chambers that can be used for, as an example, retailing and entertainment purposes. The rooms can guide the passengers over multiple floors before, during and after riding in the passenger vehicle 405.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. It is therefore, contemplated that the claims will cover any such modifications or embodiments that fall within the true scope of the invention.

What is claimed is:

1. A method for animating an advertising device, the method comprising the following steps:

providing a track system;

providing a tower operatively coupled to said track, said tower comprising one or more substantially transparent sections;

providing a base support system operatively coupled to said tower, said base operatively coupled to a facade with one or more substantially non-transparent sections;

providing a vehicle system comprising a passenger-carrying vehicle that is operatively coupled to said track;

animating said advertising device by transporting said vehicle between said substantially transparent section of said tower and said substantially non-transparent section of said facade thereby simulating fluid movement between said tower and said facade.

2. The method of claim 1 wherein said animation step simulates fluid transfer within a drinking straw.

3. The method of claim 1 wherein said animation step simulates fluid transfer within a thermometer.

4. The method of claim 1 wherein said track comprises an elastic band.

5. The method of claim 1 wherein said vehicle comprises a harness.

6. The method of claim 1 wherein said vehicle simulates a mass of fluid.

7. The device of claim 1, said facade further comprising a second slot wherein said track passes through said first slot and said second slot allowing said vehicle to travel along said track and through said first slot and said second slot, thereby enhancing consumer interest in said billboard device.

8. The method of claim 1 further comprising the following steps:

providing a second tower operatively coupled to said base and operatively coupled to a second passenger-carrying vehicle, said second vehicle being operatively coupled to said track or to a second track; and animating said advertising device by transporting said second vehicle within said second tower.

9. An advertising device comprising:

a track system;

a tower operatively coupled to said track, said tower comprising one or more substantially transparent sections;

a base support system operatively coupled to said tower, said base operatively coupled to a facade with one or more substantially non-transparent sections;

a vehicle system comprising a passenger-carrying vehicle that is operatively coupled to said track;

wherein said track passes between said substantially transparent section of said tower and said substantially non-transparent section of said facade allowing said vehicle to pass along said track, thereby simulating fluid movement between said tower and said facade.

10. The device of claim 9 wherein said one or more substantially transparent sections of said tower simulates a drinking straw.

11. The device of claim 9 wherein said one or more substantially transparent sections of said tower simulates a thermometer.

12. The device of claim 9 wherein said track comprises an elastic band.

13. The device of claim 9 wherein said vehicle comprises a harness.

14. The device of claim 9 wherein said vehicle simulates a mass of fluid.

15. The device of claim 9 wherein said tower is substantially enclosed with one or more panels.

16. The device of claim 9 further comprising a second tower operatively coupled to said base and operatively coupled to a second passenger-carrying vehicle, said second vehicle being operatively coupled to said track; wherein said track passes across a substantially transparent section of said second tower allowing said second vehicle to pass along said track, thereby simulating fluid movement within said second tower.

17. The device of claim 9 further comprising a second tower operatively coupled to said base and operatively coupled to a second passenger-carrying vehicle, said second vehicle being operatively coupled to a second track; wherein said second track passes across a substantially transparent section of said second tower allowing said second vehicle to pass along said second track, thereby simulating fluid movement within said second tower.

18. A method for animating an advertising billboard device, the method comprising the following steps:

providing a track system;

providing a base support system operatively coupled to said track;

providing a facade operatively coupled to said base, said facade comprising a first slot that said track passes through;

providing a vehicle system comprising a rider-carrying vehicle that is operatively coupled to said track;

animating said advertising device by transporting said vehicle along said track and through said slot of said facade, thereby enhancing consumer interest in said billboard device.

19. The method of claim 18 wherein said animating step further comprises transporting said vehicle along said track and through a second slot of said facade, thereby enhancing consumer interest in said billboard device.

* * * * *